United States Patent [19]

Okumoto et al.

[11] Patent Number: 4,671,299

[45] Date of Patent: Jun. 9, 1987

[54] TOBACCO MANUFACTURING MACHINE

[75] Inventors: Yutaka Okumoto, Musashino; Takao Furukawa, Tokyo; Mikio Komori, Matsudo, all of Japan

[73] Assignee: Japan Tobacco, Inc., Tokyo, Japan

[21] Appl. No.: 686,857

[22] Filed: Dec. 27, 1984

[30] Foreign Application Priority Data

Dec. 27, 1983 [JP] Japan ..... 58-244867

[51] Int. Cl.[4] ..... A24C 5/31; A24C 5/14

[52] U.S. Cl. ..... 131/60; 131/280; 131/84.1; 131/84.3; 131/108; 131/910

[58] Field of Search ..... 131/94, 95, 909, 910, 131/280, 108, 110, 84.1, 84.3, 84.4, 60

[56] References Cited

U.S. PATENT DOCUMENTS

| | | | |
|---|---|---|---|
| 3,915,176 | 10/1975 | Heitmann et al. | 131/84.3 |
| 4,175,570 | 11/1979 | Heitmann | 131/84.3 |
| 4,367,758 | 1/1983 | Seragnoli | 131/84.3 |
| 4,474,190 | 10/1984 | Brand | 131/84.4 |

*Primary Examiner*—V. Millin
*Assistant Examiner*—H. Macey
*Attorney, Agent, or Firm*—Armstrong, Nikaido, Marmelstein & Kubovcik

[57] ABSTRACT

A tobacco manufacturing machine including a cover which covers the whole of the machine, a plurality of openable doors disposed in positions corresponding to various portions of the machine which require a manual correction by an operator, power sources for opening and closing those doors, a plurality of sensors attached to various portions of the machine for detecting states which require such a correction and a door opening and producing signals, and control means for logically processing the signals provided from those sensors and producing an operating signal for operating the power source corresponding to the door to be opened. Since the whole of the machine is covered, it is possible to greatly reduce noise during high-speed operation. Because the doors corresponding to various portions of the machine are opened automatically, the troublesome work involved in manual operation is eliminated.

2 Claims, 13 Drawing Figures

TOBACCO MANUFACTURING MACHINE

BACKGROUND OF THE INVENTION

The present invention relates to a tobacco manufacturing machine such as a tobacco paper rolling machine for rolling shredded tobacco leaves automatically with a wrapping paper to finish cigarettes.

In this type of machines, speed-up of operation has been remarkable recently, and even a machine capable of manufacturing more than 8,000 cigarettes per minute has been developed. However, with speed-up of operation, the noise from the tobacco paper rolling machine during operation has been becoming larger even to an extent exceeding the standard level based on the noise regulation which is yearly becoming severer.

The simplest measure against such noise is to cover the entirety of the machine. But, in this type of machines, it is necessary for the operator to perform various manual correction operations for each part of the machine while stopping operation temporarily, and therefore the cover must be provided with openable doors in positions corresponding to such various portions of the machine.

In the conventional tobacco paper rolling machine, when the operation stops, the operator judges which of plural doors should be opened according to the cause, and manually opens the door and closes it after completion of the correction required. Consequently, even a door which need not be opened is often opened erroneously, and from the time when the operator opens the correct door corresponding to the cause and completes the required correction until when he closes the door, troublesome extra work is required in addition to the actual work required. Thus, the working efficiency is poor.

SUMMARY OF THE INVENTION

The present invention has been accomplished in order to eliminate the above-mentioned drawbacks of the prior art, and it is the object thereof to provide a tobacco manufacturing machine in which doors each adapted to be opened and closed by operation of a power source are provided in positions corresponding to various portions of the machine. Which should be opened is judged on the basis of outputs of sensors disposed in various portions of the machine. The power source corresponding to that door is operated in accordance with the result of the judgement to open automatically the door corresponding to the portion of the machine where the required correction must be done, whereby the manual door opening by the operator is eliminated to improve the working efficiency.

BRIEF DESCRIPTION OF THE DRAWINGS

The drawings illustrate an embodiment of the present invention, in which.

DETAILED DESCRIPTION OF THE EMBODIMENTS

A closely related invention to the present one is disclosed in the applicants co-pending application Ser. No. 686,867, filed Dec. 27, 1984, now U.S. Pat. No. 4,619,277.

An embodiment of the present invention will be described hereinunder with reference to the drawings.

Figure 1:
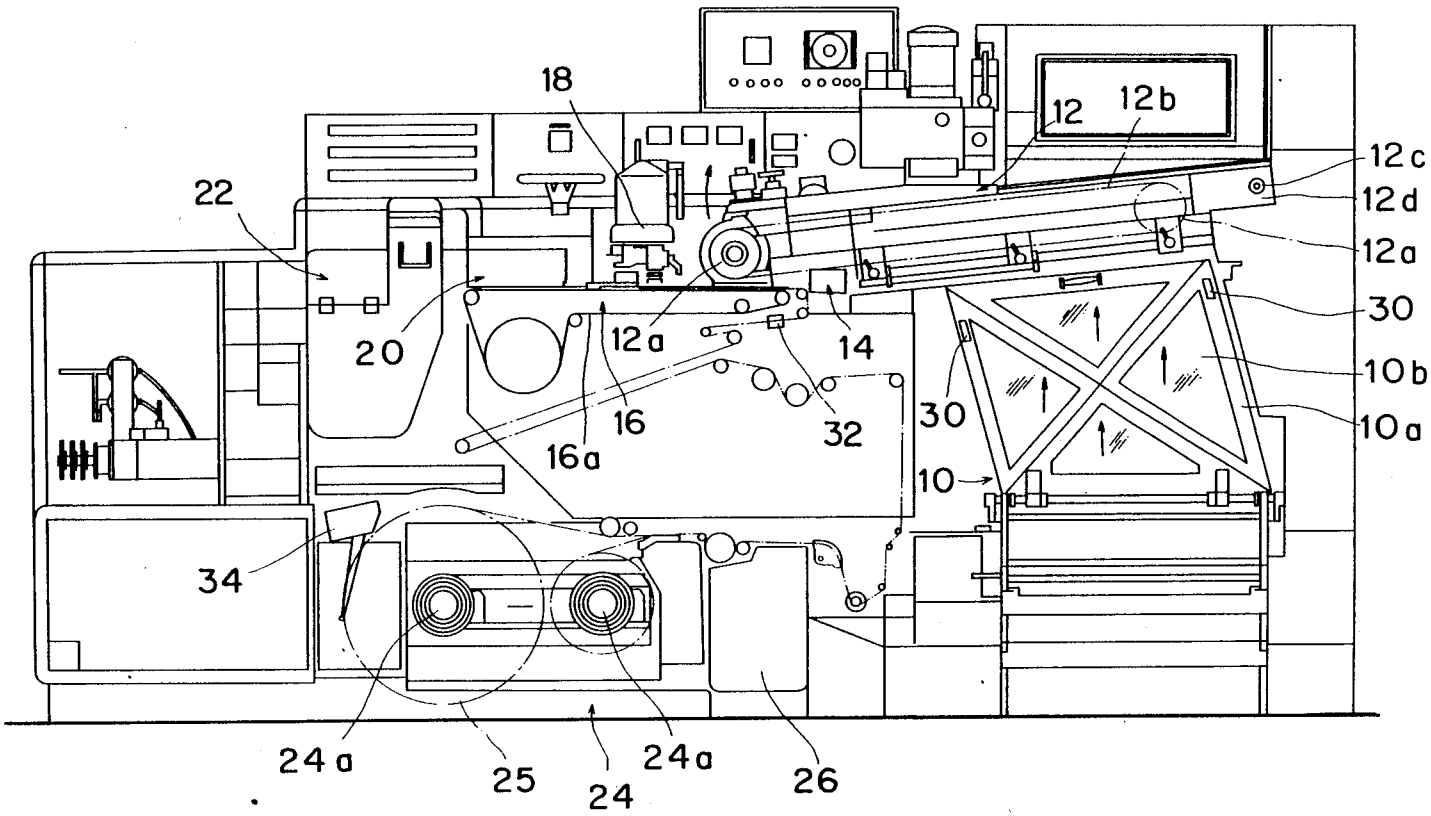
FIG. 1 is a front view showing an example of a tobacco paper rolling machine to which the invention is applied.

FIG. 1 is a front view of a tobacco paper rolling machine to which the invention is applied, in which the reference numeral 10 denotes a shredded tobacco leaves feed portion for feeding shredded tobacco leaves to be rolled with a wrapping paper in this machine. Shredded tobacco leaves are blown upwardly in the direction of the arrows in the figure by wind pressure generated by a blower. The passageway of the blown-up shredded tobacco leaves is covered with an openable cover 10*a* for a later-described purpose. The cover 10*a* is provided with a see-through window 10*b* so that the interior of the passage can be seen from the exterior.

The numeral 12 denotes a shredded tobacco leaves transfer portion for holding and transferring the shredded tobacco leaves blown up by the shredded tobacco leaves feed portion 10. More specifically, an endless belt 12*b* called a tobacco band and formed with many holes is stretched substantially horizontally between a pair of rotating members 12*a* which are rotated by a drive source. The inside of the endless belt 12*b* is reduced in pressure by sucking air through the above holes. By this sucking force, the shredded tobacco leaves are held on the surface of the belt 10*b* and transferred from right to left in the figure substantially horizontally. The rotating members 12*a* are supported rotatably by a support frame 12*d* which is pivotably supported at one end thereof about a pivot shaft 12*c*. The support frame 12*d* is pivotally moved in the direction of the arrow in FIG. 1 for the later-described purpose.

The numeral 14 denotes a trimming portion for scraping off surplus shredded tobacco leaves so that the quantity of shredded tobacco leaves which are transferred while being held on the surface of the belt 12*b* of the shredded tobacco leaves feed portion 12 is adjusted to the quantity required for the subsequent rolling of the leaves with a wrapping paper.

The numeral 16 denotes a tubular rolling portion for tubularly wrapping the rolling paper which receives thereon the shredded tobacco leaves transferred by the shredded tobacco leaves transfer portion 12. More specifically, a continuous web of paper is fed from a later-described wrapping paper feed portion onto an endless belt 16*a* made of cloth called a garniture tape, shredded tobacco leaves are put thereon. In this state, the belt 16*a* is passed through a tubular mold, whereby the wrapping paper is also transformed following the belt 16*a* and forms a rolled tube wrapping therein the shredded tobacco leaves.

The numeral 18 denotes a pasting portion for pasting and bonding both side edges of the wrapping paper as a final stage operation in the tubular rolling portion 16. This pasting is performed during transformation of the wrapping paper into a tube.

The numeral 20 denotes a heater portion for drying the bonded portion of the wrapped paper to ensure the bonding, and the numeral 22 denotes a cutting portion for cutting the continuous wrapped tube into pieces of a predetermined length.

The numeral 24 denotes a wrapping paper feed portion for feeding the web of paper to be rolled in the tubular wrapping portion. The wrapping paper feed portion 24 has a pair of wrapping paper bobbins, and an ordinary paper feed is performed from a wrapping paper roll 25 mounted on the left-hand bobbin 24*a*. When the diameter of the paper roll on the roll 25 becomes smaller than a predetermined value, the roll 25 is moved in the illustrated direction together with the bobbin 24*a* up to the position of the right-hand bobbin 24*a* and in this position the feed of wrapping paper is continued. In order that new wrapping paper can be fed continuously to the terminal end of the wrapping paper on the right-hand bobbin 24*a* when the latter paper has run out, the bobbin 24*a* with a new wrapping paper loaded thereon is set beforehand in the left-hand bobbin portion.

The numeral 26 denotes an automatic paper connecting portion for automatically connecting the leading end of the paper from the left-hand new paper roll to the terminal end of the right-hand paper roll of a smaller diameter when the latter paper roll has run out.

In the tobacco paper rolling machine of the above construction, it becomes necessary for the operator to perform certain operations when the constituent portions of the machine have each assumed a predetermined state.

Firstly, when the quantity of shredded tobacco leaves fed from the shredded tobacco leaves feed portion 10 becomes larger than that of shredded tobacco leaves transferred by the shredded tobacco leaves transfer portion 12 and the quantity of shredded tobacco leaves held on the surface of the belt 12*b* exceeds a predetermined level, it is no longer easy to smoothly transfer the shredded tobacco leaves, so it is necessary to temporarily stop the machine, open the cover 10*a* of the passageway and scrape off the shredded toabcco leaves accumulated in and causing clogging of the passageway. In this connection, a clogging sensor means 30 is attached to the passageway of the shredded tobacco leaves feed portion 10 for detecting that the quantity of shredded tobacco leaves accumulated in the upper portion of the passageway has reached a predetermined level. A reflection type photo coupler is used as the sensor means 30.

Secondly, in the event that the paper being fed from the wrapping paper feed portion 24 to the tubular rolling portion 16 is cut during its feed, it is no longer possible to continue the feed of paper and it becomes necessary to temporarily stop the machine, newly entrain the cut wrapping paper around the rollers disposed between the paper feed portion and the tubular rolling portion and set the leading end thereof to the inlet of the tubular rolling portion 16. In this connection, a wrapping paper cutting sensor means 32 is attached to the paper feed passage extending to the tubular rolling portion 16. A photo coupler comprising a light emitting element and a light receiving element which are disposed in an opposed relation to each other with respect to the wrapping paper feed passage can be used as the sensor means 32.

Thirdly, when the diameter of the paper roll on the left-hand paper bobbin 24*a* becomes smaller than a predetermined value, it is necessary to move the roll thus reduced in diameter to the right, then load a new paper roll on the left side and perform a predetermined setting operation for automatically connecting the leading end of the new roll to the terminal end of the paper roll of reduced diameter when the latter has run out. In this connection, there is provided a roll diameter sensor means 34 for detecting a diameter of the left-hand paper roll smaller than the predetermined value. As the sensor means 34, for example, a limit switch having a movable contact lever 3-a adapted to move along the outer periphery of the roll as shown in the figure, or a rotary encoder adapted to rotate together with the bobbin 24*a* and detect the paper roll diameter from the number of revolutions of the bobbin can be used.

Figure 2:
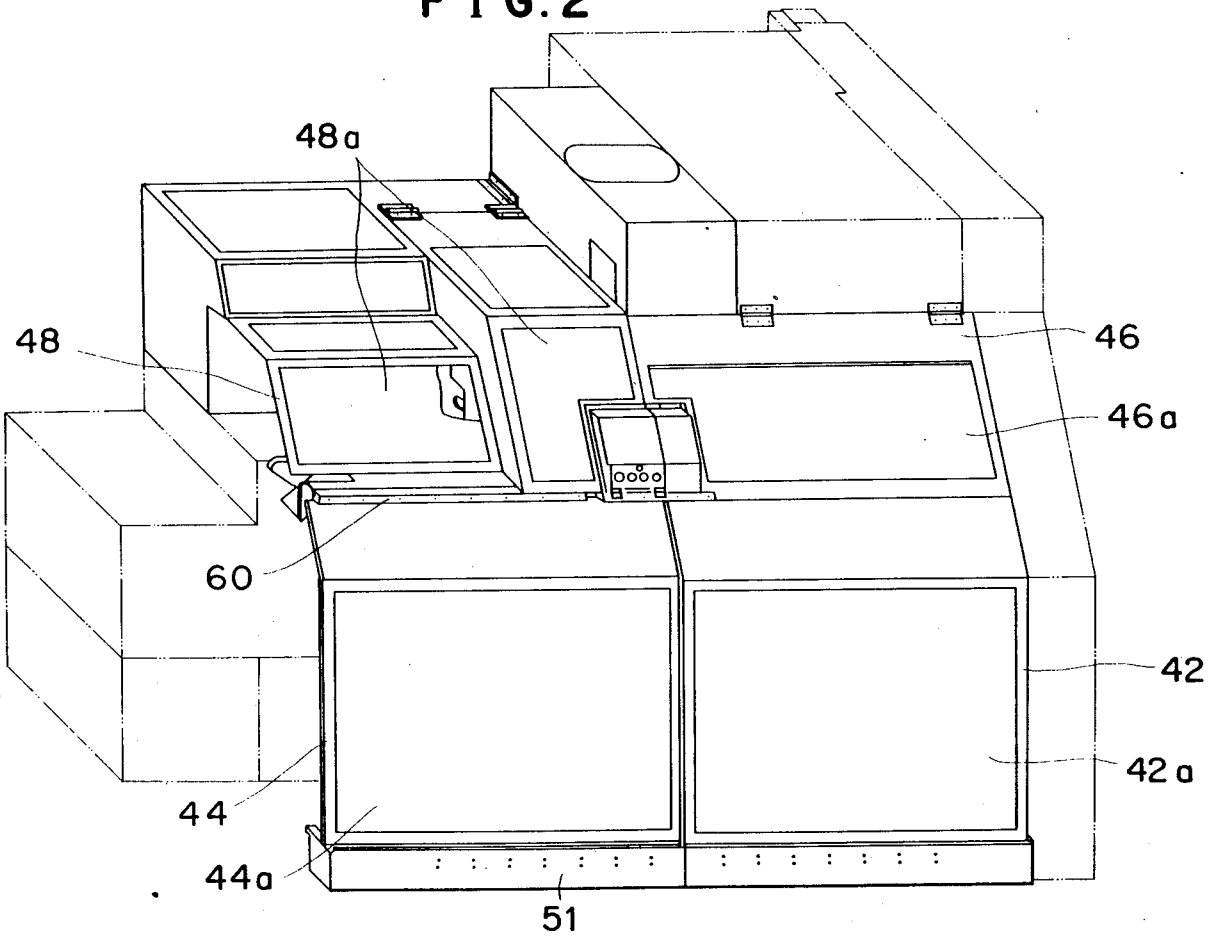
FIG. 2 is a perspective view of the paper rolling machine of FIG. 1 in a wholly covered state.

FIG. 2 is a perspective view showing the construction of a cover which covers the entirety of the tobacco paper rolling machine to reduce noise during operation of the machine.

The cover is provided with first and second transversely sliding doors 42 and 44 in opposed relation respectively to the shredded tobacco leaves feed portion 10 and wrapping paper feed portion 24 which are disposed below the shredded tobacco leaves transfer portion 12 and tubular rolling portion 16 respectively, the tubular rolling portion 16 being adjacent to the left side of the transfer portion 12. Further, above the first and second doors 42 and 44 are respectively provided upper hinged third and fourth doors 46 and 48 which are divided on an extension of the boundary between the doors 42 and 44 and which are substantially opposed to the shredded tobacco leaves transfer portion 12 and tubular rolling portion 16 respectively. Main portions of the first to fourth doors 42 to 48 comprise see-through windows 42*a* to 48*a* which are, for example, transparent acrylic resin plates fitted in the doors 42–48 so that the corresponding inside portions can be seen from the outside in a closed state of those doors.

The opening and closing construction of the doors 42 to 48 will be described in detail hereinunder with reference to FIGS. 3 to 13.

Figure 3:
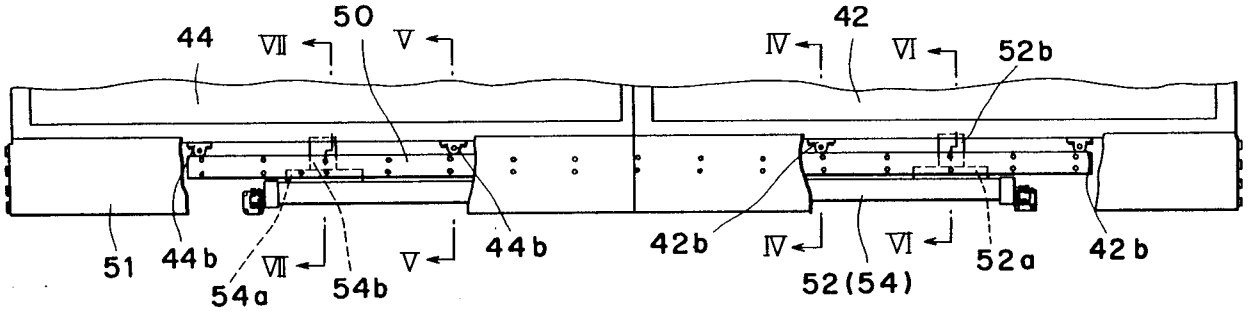
FIG. 3 is a partially cut-away enlarged view showing front of a portion of FIG. 2.
Figure 4:
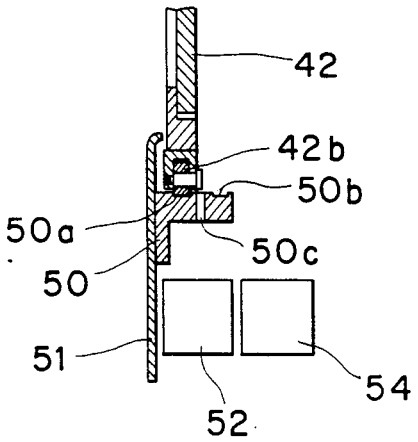
FIG. 4 is a sectional view taken on line IV—IV of FIG. 3.
Figure 5:
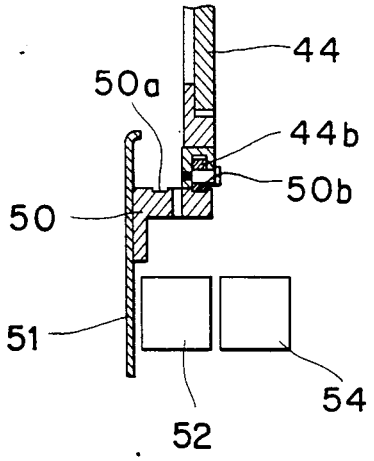
FIG. 5 is a sectional view taken on line V—V of FIG. 3.

In FIG. 3, the numeral 50 denotes a first guide rail for transversely guiding the lower ends of the doors 42 and 44. The first guide rail 50 is attached to a mask member 51 which is fixed to the floor surface. In the upper surface of the guide rail 50 are formed two guide channels 50*a* and 50*b* in which are fitted rollers 42*b* and 44*b* respectively, the rollers 42*b* and 44*b* being mounted to the lower ends of the doors 42 and 44 respectively, (FIGS. 4 and 5). Below the guide rail 50 are disposed side by side two drive cylinders 52 and 54 as drive sources for opening and closing the doors 42 and 54. A movable piece 52*a* of the drive cylinder 52 is connected to the lower end of the door 42 through a connecting piece 52*b* inserted into a longitudinal hole 50*c* which is formed between the guide channels 50*a* and 50*b* (FIG.

Figure 7:
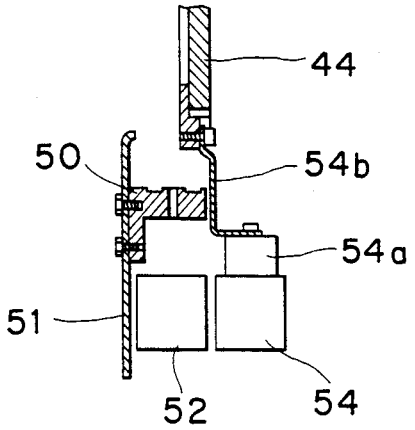
FIG. 7 is a sectional view taken on line VII—VII of FIG. 3.
Figure 6:
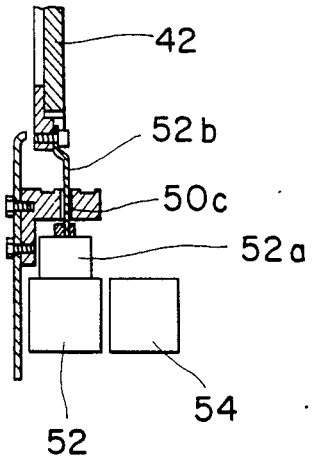
FIG. 6 is a sectional view taken on line VI—VI of FIG. 3.

6). On the other hand, a movable piece 54*a* of the drive cylinder 54 is connected to the lower end of the door 44 through a connecting piece 54*b* (FIG. 7).

Figure 8:
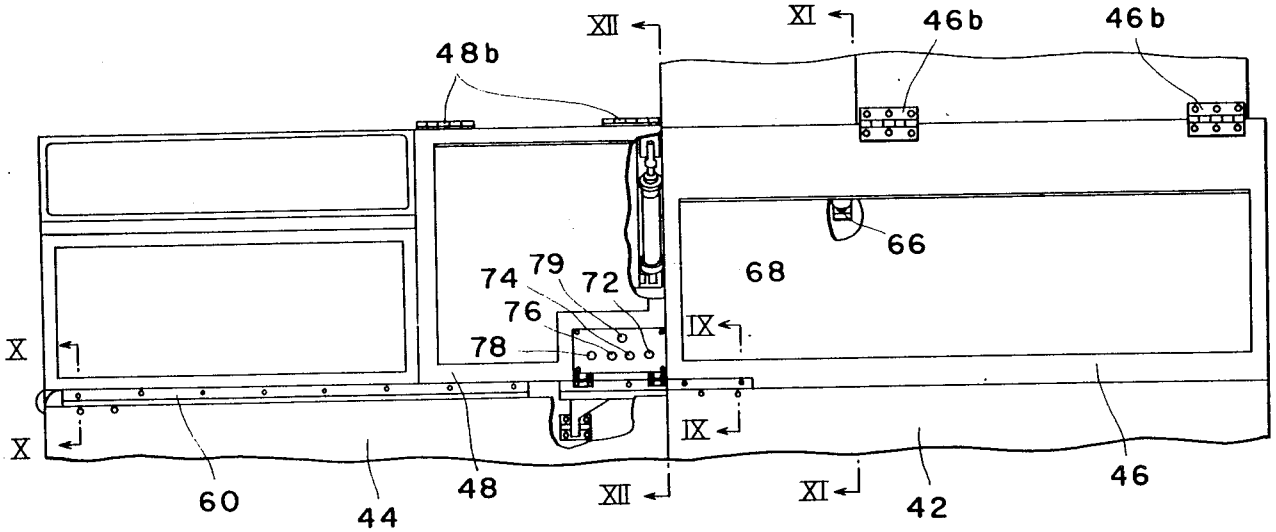
FIG. 8 is a partially cut-away enlarged view showing the front of another portion of FIG. 2.
Figure 9:
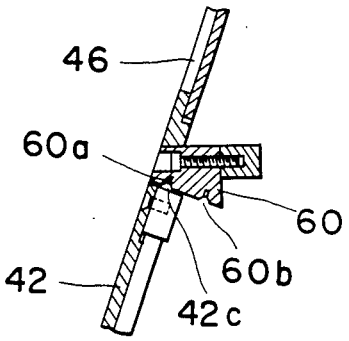
FIG. 9 is a sectional view taken on line IX—IX of FIG. 8.
Figure 10:
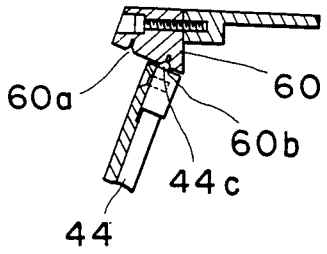
FIG. 10 is a sectional view taken on line X—X of FIG. 8.

In FIG. 8, the numeral 60 denotes a second guide rail for transversely guiding the upper ends of the doors 42 and 44. The second guide rail 60 is mounted along the tubular rolling portion 16 and it is formed with V grooves 60*a* and 60*b* in which are fitted balls 42*c* and 44*c* respectively, the balls 42*c* and 44*c* being disposed on the left-hand sides of the upper ends of the doors 42 and 44 respectively, (FIGS. 9 and 10). With the above construction, the movable pieces 52*a* and 54*a* are moved upon operation of the drive cylinders 52 and 54, whereby the doors 42 and 44 are moved to the left and right respectively and thus opened.

Figure 11:
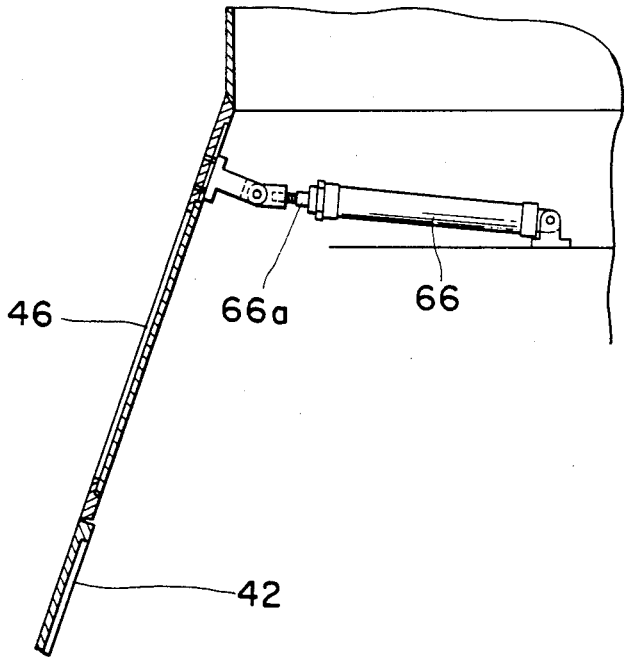
FIG. 11 is a sectional view taken on line XI—XI of FIG. 8.
Figure 12:
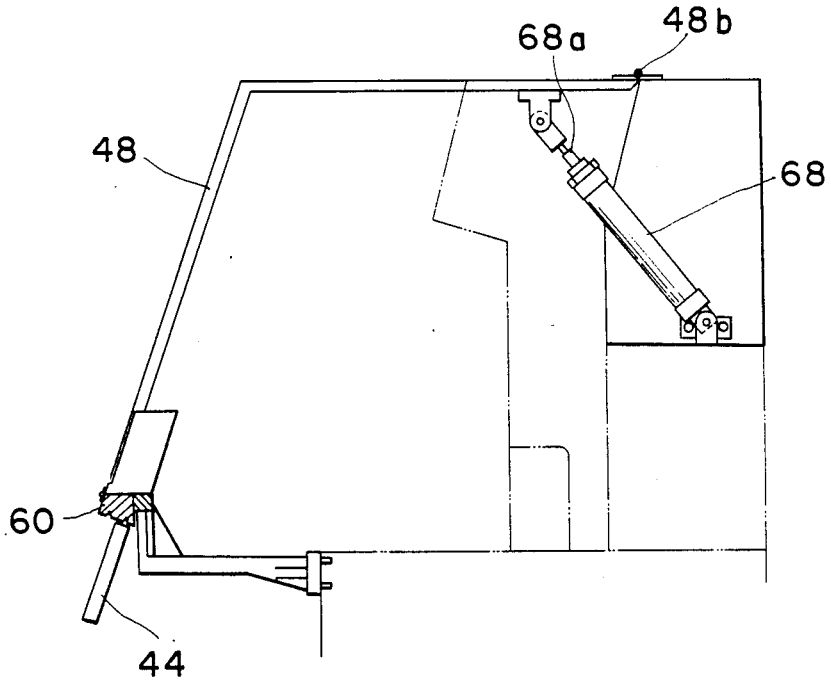
FIG. 12 is a sectional view taken on line XII—XII of FIG. 8.

The doors 46 and 48 are attached at their upper ends to stationary portions of the cover respectively through hinges 46*a* and 48*b* so that they can be opened and closed. To the inner surfaces of the doors 46 and 48 are pivotably connected movable pieces 66*a* and 68*a* of drive cylinders 66 and 68 as power sources which are pivotably attached to any desired portions of the machine (FIGS. 11 and 12). Consequently, the doors 46 and 48 are opened upward upon operation of the cylinders 66 and 68. At the crossing portion of the four doors 42 to 48 there are provided four opening/closing button switches 72 to 78 for operating the cylinders corresponding to the doors and opening and closing the doors manually independently, as well as a closing button switch 79 for simultaneously closing all the doors opened automatically.

Figure 13:
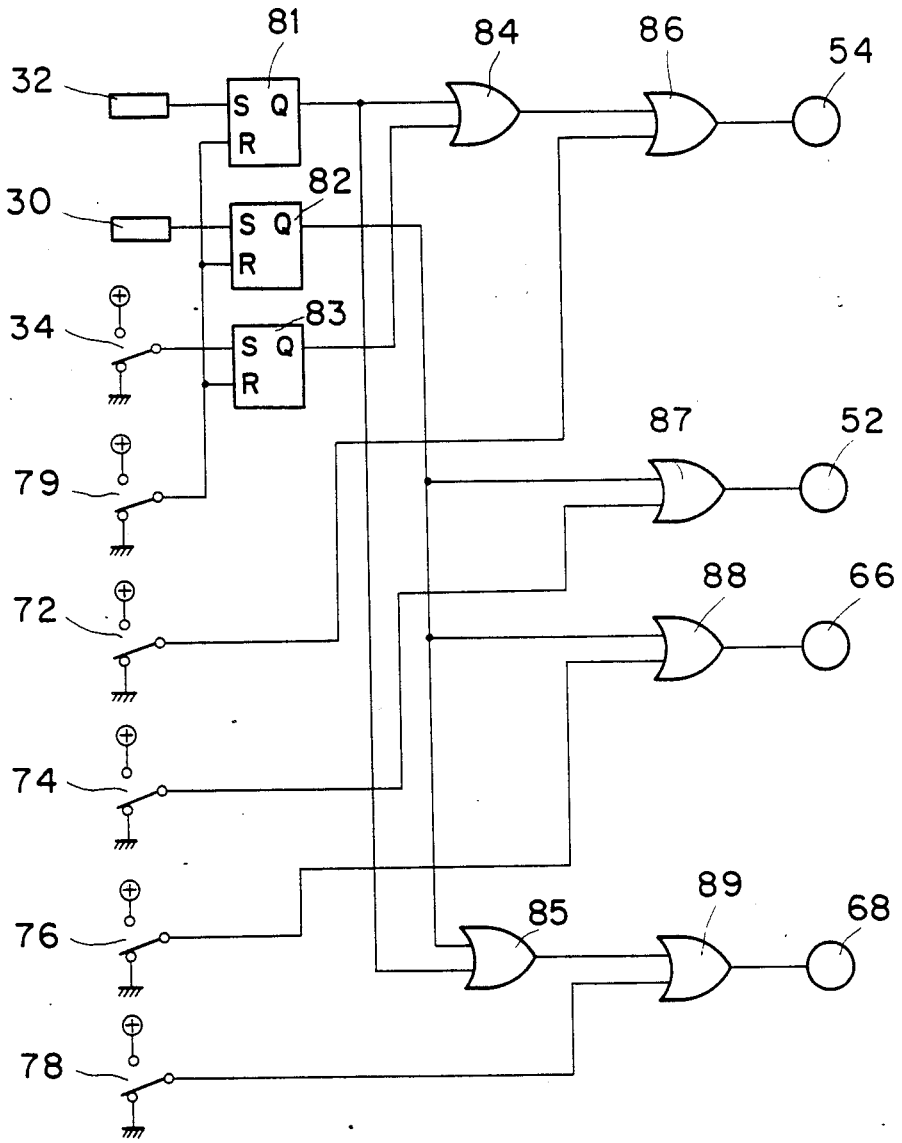
FIG. 13 is an electric circuit diagram showing an example of a control circuit.

FIG. 13 illustrates a control circuit which produces signals for actuating the cylinders 52, 54, 66 and 68 corresponding respectively to the doors 42 to 48 upon input from the various sensor means 30–34 and operating button switches 72–79. Operation of this circuit will be described below.

When the sensor means 32 detects cutting of the wrapping paper and produces an output signal of H level, an R-S flip flop (FF) 81 set in response to the leading edge of the signal and its output Q goes from L to H level. As a result, OR gates 84, 85, 86 and 89 produce output signals of H level and so the cylinders 54 and 68 adapted to be controlled by the outputs of the OR gates 86 and 89 are actuated in the opening direction, whereby the doors 44 and 48 are simultaneously opened automatically. Therefore, the operator can immediately perform the work of entraining the cut wrapping paper around the rollers positioned in the wrapping paper feed passage and setting its fore end to a predetermined position in the tubular rolling portion 16. When the machine is re-started after setting the paper to the predetermined position, it is slowed down, during which the state of operation of the machine is checked until the absence of problem is confirmed, whereupon the button switch 79 for high-speed operation is pushed, whereby the FF 81 is reset and its output Q becomes L level. As a result, the outputs of the OR gates 86 and 89 change from H to L level and the cylinders 54 and 68 revert to the original closed state, so the doors 44 and 48 are closed simultaneously.

Next, in the event the shredded tobacco leaves are accumulated in the shredded tobacco leaves feed passageway, causing clogging of the passage, and the output of the sensor means 30 becomes H level, the R-S FF 82 is set and its output Q also goes high. As a result, the outputs of the OR gates 85, 87, 88 and 89 become H level and the cylinders 52, 66 and 68 adapted to be controlled by the outputs of the OR gates 87, 88 and 89 are actuated in the opening direction, so that the doors 42, 46 and 48 are automatically opened simultaneously. Therefore, it is possible to immediately pivot the support frame 12*d* in the shredded tobacco leaves transfer portion 12 in the direction of the arrow as illustrated about the pivot shaft 12*c* to scrape off the shredded tobacco leaves accumulated on the belt 12*b* and in the shredded tobacco leaves feed passageway. If the operation is re-started after this trimming work and then after a while the high-speed operation button switch 79 is pushed, the FF 82 is reset and its Q output becomes L level, so that the cylinders 52, 66 and 68 operate in the direction of closing the doors 42, 46 and 48.

Further, when it is detected by the sensor means 34 that the diameter of the paper roll in the paper feed portion 24 has become smaller than the predetermined value, the R-S FF 83 is set in response thereto and its output becomes H level. As a result, the outputs of the OR gates 84 and 86 become H level and the cylinder 54 adapted to be controlled by the output of the OR gate 86 is actuated in the opening direction, so the door 44 is opened automatically. Therefore, the operator can immediately change the position of the paper roll now reduced in diameter and perform the setting of a new paper roll and that for automatic paper connection. At this time, it is not always necessary to stop the operation of the machine, which may be in a state of low-speed operation. If the high-speed operation button switch 79 is pushed after completion of predetermined corrections, the FF 83 is reset and the door 44 is automatically closed by the cylinder 54 in response thereto.

The button switches 72 to 78 comprise change-over switches which, for example, switch to one side upon one depression and to the other side upon another depression. According to the state of operation of each button switch, the corresponding door is opened or closed.

In the above embodiment the doors 46 and 48 are disposed in opposed relation to the shredded tobacco leaves transfer portion 12 and the tubular rolling portion 16, respectively, but even if only one door is provided for both such portions, there will be no practical problems.

Further, although the doors 46 and 48 are of an upwardly hinged construction, they may be constructed so as to be movable upward along the plane of the door, and this construction is desirable in eliminating the possibility of an automatically opening door striking a worker.

According to the present invention, as set forth hereinabove, since the whole of the machine is covered, it is possible to greatly reduce noise induced by the machine during high-speed operation. Besides, since the doors corresponding to various portions of the machine which require correction operations by the operator can be opened automatically, the troublesome work of judging the door to be opened and opening it manually during operation is no longer necessary, thus improving the working efficiency.

What is claimed is:

1. A tobacco manufacturing machine including a cover which covers the whole of the machine, a plurality of openable doors on said cover disposed in positions corresponding to various portions of the machine which may require a manual correction by an operator, power source means for opening and closing said doors, a plurality of sensor means attached to various portions of the machine for detecting states which require a manual correction and a door opening and producing signals when a manual correction is needed at the particular portion, and control means for logically processing the signals provided from said sensor means and producing an operating signal for operating the power source means corresponding to the door to be opened.

2. A tobacco manufacturing machine including a tobacco paper rolling machine, said tobacco paper rolling machine having:

a shredded tobacco leaves feed means for blowing up upwardly shredded tobacco leaves and feeding them through a shredded tobacco leaves feed passage passageway;

a shredded tobacco leaves transfer means located above said shredded tobacco leaves feed means for transferring the shredded tobacco leaves which are blown up upwardly through the shredded tobacco leaves feed means, in a substantially horizontal direction while holding the leaves on the surface of a moving endless belt;

a tubular rolling means which receives on a tobacco wrapping paper the shredded tobacco leaves transferred from said shredded tobacco leaves transfer means for rolling the wrapping paper tubularly while moving it substantially horizontally;

a wrapping paper feed means for feeding the wrapping paper continuously from a preset paper roll to said tubular rolling means through a paper feed passage;

clogging sensor means attached to said shredded tobacco leaves feed passageway for detecting clogging of said passageway with shredded tobacoo leaves;

cutting sensor means attached to said paper feed passage for detecting when the paper has been accidently cut therein; and roll diameter sensor means attached to said paper feed means for detecting that the diameter of the set paper roll has become smaller than a predetermined value;

the whole of said tobacco paper rolling machine being covered with a cover, said cover having openable doors in positions corresponding respectively to said shredded tobacco leaves feed means and said wrapping paper feed means, as well as at least one door for said shredded tobacco leaves transfer means and said tubular rolling means, said doors corresponding respectively to said shredded tobacco leaves feed means and said wrapping paper feed means being transversely sliding doors, said door for said shredded tobacco leaves transfer means and said tubular rolling means being opened upwardly, power sources being provided in corresponding relation to said doors and operated selectively in accordance with output signals provided from at least one of said sensor means to open one or more of said plural doors automatically.

* * * * *